United States Patent [19]

Thorp

[11] 4,415,191

[45] Nov. 15, 1983

[54] DOOR LOCKING MECHANISM

[76] Inventor: James B. Thorp, 5739 Rowland, Temple City, Calif. 91780

[21] Appl. No.: 284,644

[22] Filed: Jul. 20, 1981

[51] Int. Cl.[3] ..... E05C 21/00

[52] U.S. Cl. ..... 292/346; 292/340

[58] Field of Search ..... 292/346, 340

[56] References Cited

U.S. PATENT DOCUMENTS

| | | | |
|---|---|---|---|
| 1,215,384 | 2/1917 | Kline | 292/346 |
| 2,255,860 | 9/1941 | Riedel | 292/346 X |
| 3,279,840 | 10/1966 | Barone | 292/346 |
| 3,592,498 | 7/1971 | Raccuglia, Sr. | 292/346 |
| 3,934,910 | 1/1976 | Radke | 292/346 |
| 4,279,436 | 7/1981 | Heffel | 292/346 |

FOREIGN PATENT DOCUMENTS

| | | | |
|---|---|---|---|
| 983551 | 2/1976 | Canada | 292/346 |

*Primary Examiner*—Richard E. Moore

*Attorney, Agent, or Firm*—Boniard I. Brown

[57] ABSTRACT

A reinforcing structure for an associated door and lock mechanism of a type having a bolt. The door abuts an elongated door stop carried on a door jamb in the closed position. A strike plate has a bolt receiving aperture therein and is dimensioned and configured to have at least portions extending into recesses in the associated elongated door stop. Screws extend through the portions for mounting the strike plate on the associated door jamb. A jamb plate is dimensioned and configured for mounting on the door stop with a first edge thereof in generally parallel relationship to a side of the strike plate and extending substantially to an edge of the door stop which abuts the associated door when in the closed position. In some forms of the invention a first reinforcement plate is disposed on at least one side of the door, surrounding means for operating the bolt, and is dimensioned and configured for extending into the recess in the jamb plate.

8 Claims, 3 Drawing Figures

10
16
18
14
19
53
52
54
58
34
34
22
28
53
26
34
32
24
53
60
56
48
34
62
50
12
70
68
64
3
3

19
18
22
30
58
53
52
70
34
14
26
60
28
68
20
50
48
64
12

14
18
19
48
52
40
22
34
42
54
26
34
30
24
32
53
58
34
44
34
28
46
53
56

DOOR LOCKING MECHANISM

BACKGROUND OF THE INVENTION

This application relates to apparatus which advantageously cooperates with the apparatus shown in copending U.S. patent application Ser. No. 216,546 filed Dec. 15, 1980. It will be understood that although the apparatus in the present invention does cooperate advantageously with the apparatus shown in the copending application, that the apparatus described and claimed in the present application may also be used independently of the apparatus shown in the copending application.

The present invention relates to building construction, and particularly to apparatus for reinforcing a door in the immediate area of a locking mechanism.

Rising crime rates have focused attention on the importance of sturdy locking mechanisms in order to reduce the probability of breaking and entering, not only into private dwellings but also into other buildings. A weakness of many existing locking mechanisms is that when installed on a door they are vulnerable to prying and gouging of the bolt and/or the strike plate. Most strike plates do not cooperate with the door stop and for this reason alone are vulnerable. The door stop is, of course, the vertical strip, often manufactured of wood, which normally touches a portion of the periphery of the inside face of a door and which limits the travel of the door inward. The door stop normally extends along the vertical edge of the door from the top to the bottom.

Elongated strike plates are known which extend vertically under the stop and which have additional mounting screws engaging the extremities of the striker plate. Other structures have used boxes to enclose the bolt. These attempts to minimize vulnerability of the bolt to prying and gouging have not been wholly satisfactory.

It is an object of the invention to provide a mechanism which is stronger than many other locking mechanisms.

It is another object of the invention to provide apparatus which will make it more difficult to pry or gouge the bolt.

Another object of the invention is to provide apparatus which will make it more difficult to pry or gouge the strike plate in order to gain entry to the building on which it is installed.

SUMMARY OF THE INVENTION

The foregoing objects and other objects and advantages which shall become apparent from the detailed description of the preferred embodiment are attained in an apparatus which includes a reinforcing structure for an associated door and lock mechanism of a type having a bolt. The door abuts an elongated door stop carried on a door jamb in the closed position. A strike plate has a bolt receiving aperture therein and is dimensioned and configured to have at least portions extending into recesses in the associated elongated door stop. Fastening means extend through the portions for mounting the strike plate on the associated door jamb. A jamb plate is dimensioned and configured for mounting on the door stop, with a first edge thereof in generally parallel relationship to a side of the strike plate. The jamb plate also extends substantially to an edge of the door stop which abuts the closed associated door.

In some forms of the invention a first reinforcement plate is disposed on at least one side of the door, surrounding means for operating the bolt, and is dimensioned and configured for extending into a recess in the jamb plate.

The portions may be tabs and the strike plate may be generally planar. The tabs may extend into recesses in the associated door stop. The recess in the jamb plate may be in the first edge thereof. The strike plate may have two retaining tabs and the tabs may be disposed at axially spaced portions of the strike plate for installation at elevational positions above and below the bolt received in the aperture therein. The apparatus may further include a second plate surrounding the means for operating on a side of the associated door opposite to the side in which the first plate may be disposed.

BRIEF DESCRIPTION OF THE ACCOMPANYING DRAWING

DESCRIPTION OF THE PREFERRED EMBODIMENT

Figure 1:
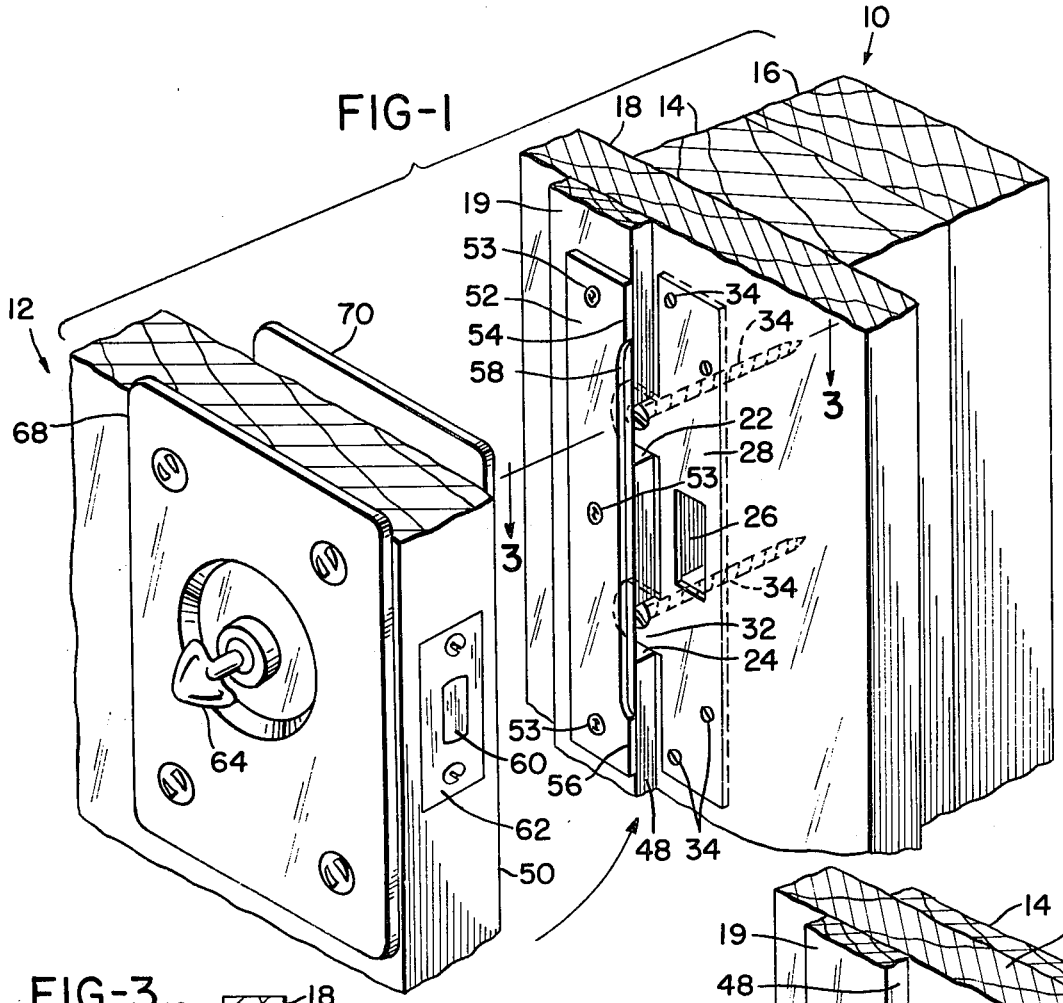
FIG. 1 is a perspective view of portions of a cooperating door and door jamb locking from the inside of a building toward the outside, the door being rotated somewhat in order to better illustrate the geometry of that door.
Figure 3:
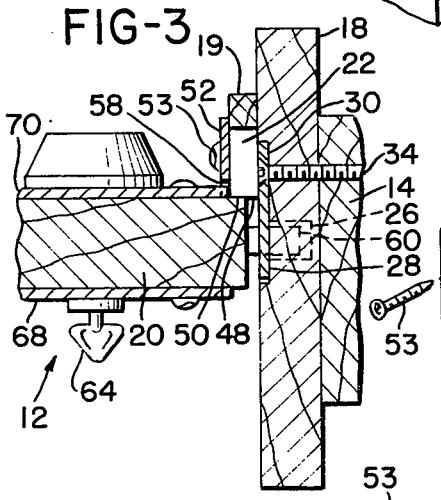
FIG. 3 is a fragmentary sectional view taken along the line 3—3 of FIG. 1.
Figure 2:
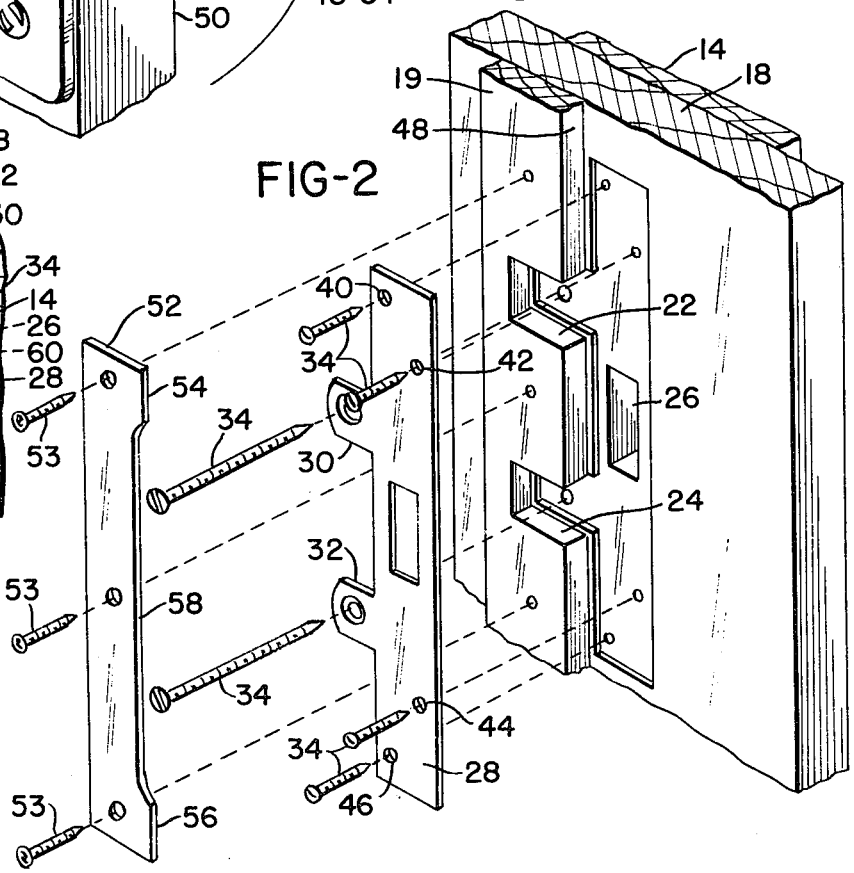
FIG. 2 is a perspective view illustrating a portion of the apparatus of FIG. 1 in exploded relation.

Referring not to FIGS. 1, 2 and 3, there is shown a door jamb assembly 10 which cooperates with a door assembly 12. The door jamb assembly 10 includes framing members 14, 16 which are disposed in paralled side abutting relationship and support a jamb 18.

Disposed on the jamb 18 is an elongated door stop 19 which ordinarily will extend for substantially the entire vertical extent of the door 20 of the door assembly 12. The door stop 19, in the preferred form of the invention, is provided with first and second recesses 22, 24. The recesses 22, 24 are disposed respectively above and below an aperture 26 in the strike plate 28. The strike plate 28 includes tabs 30, 32 which are disposed in registering relationship to the recesses 22, 24 in the door jamb 18. The strike plate 28 is ordinarily mounted by a plurality of lag screws 34. The lag screws 34 are ordinarily dimensioned to extend axially at least into one of the framing members 14, 16. More specifically, the lag screws 34 ordinarily will extend through apertures located in each tab 30, 32 as well as a plurality of other apertures, such as 40, 42, 44, and 46. It will be understood that the surface 48 of the door stop 19 abuts the periphery of the planar side 50 of the door 20 when it is closed.

Disposed on the outer face of the door stop 19 in generally vertically centered relationship with respect to the aperture 26 of the strike plate 28, is a jamb plate or guard plate 52 having side extremities 54, 56 which are disposed in flush relationship to the surface 48 of the door stop 19. This side is provided with a recess 58. It will be understood that the jamb plate or guard plate 52 is disposed on the side of the door 20 which is outside and thus vulnerable to intruders.

The door assembly 12 includes the door 20, a bolt 60, face plate 62, a handle 64, as well as the usual mechanism (not shown) for translating rotary motion into rectilinear travel of the bolt 60. Disposed on each side around the handle mechanism 64 (one shown) are reinforcement plates 68, 70 to further minimize the danger of an intruder breaking and entering. The plate 70 will preferably extend to the right (as viewed in FIG. 3) beyond the jamb plate 52. Such plates 68, 70 have been described in greater detail in the applicant's copending U.S. patent application Ser. No. 216,546, Filed Dec. 15, 1980.

The recess 58 in the guard plate 52 is dimensioned and aligned with the reinforcement plate 70, as best seen in FIGS. 1 and 3. In other words, the axial extremities of the recess 58 are dimensioned and positioned to coincide with the upper and lower extremities of the plate 70. It will be seen that with this arrangement the danger of entrance of a crow-bar or a similar tool (not shown) intermediate the guard plate 52 and the plate 70 is minimized. It will be seen that the jamb or guard plate 52 is fastened by elongated one way screws 53 which permit rotation only in a single direction (the direction which tightens) with a conventional screwdriver. Such screws 53 are, of course, of the type which is commonly used in public lavatory stalls.

A shim, typically a wooden shingle, (not shown) may be disposed intermediate the jamb 10 and the stud or framing member 14 to extend along selected axial portions of the jamb 10, thus to accommodate or compensate for inaccuracies and misalignments in the members.

In operation the user merely closes the door 20, as shown in FIG. 3, and operates the knob 64 to operate the locking mechanism in exactly the same manner as he would ordinarily. The possibility of an intruder gaining access to the area around the bolt 60 is substantially minimized by the apparatus in accordance with the invention.

In various embodiments of the invention the door or guard plate 52 may have a generally L-shaped cross section (not shown) so that it extends around the door jamb to still further limit unauthorized entry into the building protected with the apparatus in accordance with the invention. In various other embodiments of the invention the strike plate 28 may be configured with arms (not shown) that extend upwardly and downwardly underneath the door jamb 10 to still further enhance the security of the apparatus.

The invention has been described with reference to its illustrated preferred embodiment. Persons skilled in the art of constructing door locking mechanisms may, upon exposure to the teachings herein, conceive variations in the mechanical development of the components therein. Such variations are deemed to be encompassed by the disclosure, the invention being delimited only by the appended claims.

The inventor claims:

1. A reinforcing structure for a door and lock mechanism wherein the door abuts an elongated door stop on a door jamb in the closed position of the door, said structure comprising:

a door stop defining at least one recess;

a strike plate defining a bolt receiving aperture and having tab portions dimensioned and configured to extend into said at least one recess in the door stop, and having fastening means for mounting said strike plate on the door jamb; and a jamb plate dimensioned and configured for mounting on the door stop with a first edge thereof in generally parallel relationship to a side of said strike plate and extending substantially to an edge of said door stop which abuts the door.

2. The apparatus as described in claim 1, wherein:

said jamb plate has at least a portion of said first edge thereof defining a recess to accommodate close extension therein of a door portion.

3. The apparatus as described in claim 1, wherein:

said strike plate has two retaining tabs axially spaced on said strike plate at elevational positions above and below said bolt receiving aperture therein.

4. A reinforcing structure for a door and lock mechanism wherein the door abuts an elongated door stop on a door jamb in the closed position of the door, said structure comprising:

a door stop on a door jamb;

a strike plate defining a bolt receiving aperture and having fastening means for mounting said strike plate on the door jamb;

a jamb plate dimensioned and configured for mounting on the door stop with a first edge thereof in generally parallel relationship to a side of said strike plate and extending substantially to an edge of said door stop which abuts the associated door, said jamb plate having a recess defined in at least a portion of its said first edge; and a reinforcement plate mounted on one side of said door and surrounding said means for operating said bolt, said plate being dimensioned and configured for extension into said jamb plate recess in substantially perpendicular relation to the jamb plate to prevent entrance of a tool between the reinforcement plate and the jamb plate when the door is in closed position.

5. The apparatus as described in claim 4, wherein:

said strike plate portions are tabs.

6. The apparatus as described in claim 5, wherein:

the door stop has recesses dimensioned, configured and positioned for engagement with said tabs.

7. The apparatus as described in claim 4, wherein:

said strike plate has two retaining tabs axially spaced on said strike plate at elevational positions above and below said bolt receiving aperture therein.

8. The apparatus as described in claims 4, 5 or 6, wherein:

said apparatus further includes a second reinforcement plate surrounding said bolt operating means on a side of the associated door opposite to the side on which said first reinforced plate is disposed.

* * * * *